United States Patent [19]

Tamura et al.

[11] Patent Number: 4,545,747

[45] Date of Patent: Oct. 8, 1985

[54] SCROLL-TYPE COMPRESSOR

[75] Inventors: Takahiro Tamura; Hiroaki Kuno; Naoshi Uchikawa; Akira Murayama; Takao Mizuno, all of Shimizu, Japan

[73] Assignee: Hitachi, Ltd., Tokyo, Japan

[21] Appl. No.: 559,089

[22] Filed: Dec. 7, 1983

[30] Foreign Application Priority Data

Dec. 17, 1982 [JP] Japan ..... 57-220065

[51] Int. Cl.[4] ..... F04C 18/02; F04C 29/08

[52] U.S. Cl. ..... 418/55; 418/98

[58] Field of Search ..... 418/55, 84, 94, 97, 418/98, 270

[56] References Cited

U.S. PATENT DOCUMENTS

| | | | |
|---|---|---|---|
| 3,834,846 | 9/1974 | Linder et al. | 418/270 |
| 4,065,279 | 12/1977 | McCullough | 418/55 |
| 4,216,661 | 8/1980 | Tojo et al. | 418/55 |
| 4,396,364 | 8/1983 | Tojo et al. | 418/55 |
| 4,431,388 | 2/1984 | Eber et al. | 418/55 |
| 4,443,166 | 3/1984 | Ikegawa et al. | 418/55 |

FOREIGN PATENT DOCUMENTS

| | | | |
|---|---|---|---|
| 53-03803 | 2/1978 | Japan . | |
| 56-20701 | 2/1981 | Japan | 418/55 |
| 56-165701 | 12/1981 | Japan | 418/55 |
| 57-73886 | 5/1982 | Japan | 418/55 |

*Primary Examiner*—John J. Vrablik
*Assistant Examiner*—Theodore Olds
*Attorney, Agent, or Firm*—Antonelli, Terry & Wands

[57] ABSTRACT

A scroll-type compressor has an orbital scroll member and a stationary scroll member each having a disc-shaped end plate and a spiral wrap protruding upright from the end plate. The scroll members are assembled together with their wraps meshing with each other to define compression chambers therebetween. The orbital scroll member executes an orbital movement without rotating around its own axis. A discharge port and a suction port are formed in a central portion and a peripheral portion of the end plate of the stationary scroll member, respectively. As the orbital scroll member makes the orbital movement, the compression chambers are moved towards the center while decreasing their volumes thereby to progressively compress a gas drawn through the suction port and to discharge the compressed gas through the discharge port. The compressor further has a check valve disposed in a gas passage which is formed through the thickness of the end plate of the stationary scroll member so as to communicate with a suction chamber formed between the scroll members.

2 Claims, 2 Drawing Figures

SCROLL-TYPE COMPRESSOR

BACKGROUND OF THE INVENTION

The present invention relates to a scroll-type compressor and, more particularly, to an improvement in the construction of the fluid inlet passage in a scroll-type compressor.

In general, an electrically driven hermetic compressor of scroll type has a compressor section and an electric motor section which are hermetically sealed in a closed vessel. The fluid passages in this type of compressor, therefore, extend through the wall of the closed vessel to external equipment such as an evaporator and a condensor in a refrigeration system. The compressor section includes a scroll-type compressor essentially having a stationary scroll member and an orbital scroll member which are assembled together with their wraps meshing with each other. The wraps of the scroll members are formed along an involute curve or a curve resembling an involute curve so as to extend upright from the end plates of respective scroll members. The suction port for the fluid is formed to open outside but near the area of the confined spaces formed between meshing wraps, while the discharge port is formed near the center of the stationary scroll member. An Oldham's ring, preventing the orbital scroll member from rotating around its own axis, is disposed between the orbital scroll member and the frame or between the orbital scroll member and the stationary scroll member. A crankshaft is connected through a bearing to the orbital scroll member so that, as the crankshaft is driven, the orbital scroll member makes an orbital movement without rotating around its own axis. This orbital movement causes a change in the volume of the closed chambers formed between two wraps of the scroll members thereby to progressively compress the fluid confined in such chambers. The compressed fluid is discharged to the outside of the compressor through a dicharge valve connected to the discharge port. In order to efficiently compress and discharge the gas, it is essential that the orbital scroll member is adequately pressed against the stationary scroll member in the axial direction. This axial pressing force is produced by the difference between the pressure of the gas acting in the compression chamber and the pressure acting on the back side of the orbital scroll member. The pressure acting on the back side of the orbital scroll member is produced by the gas which is introduced through a small communication hole providing a communication between the compression chamber and the back side of the orbital scroll member.

Additionally, bearings, sliding parts and compressor section of this type of compressor are cooled by a lubricating oil which is maintained in the closed vessel. More specifically, the lubricating oil is drawn up through an oil passage bore formed through the crankshaft and delivered to bearings due to the difference between a high pressure and an intermediate pressure. The lubricating oil is then supplied into a back-pressure chamber formed behind the orbital scroll member. The lubricating oil introduced into the back-pressure chamber is then relieved to the compression chamber through the communication hole at a suitable rate and is mixed with the gas under compression so as to be recirculated together with the gas.

A typical example of the electrically-driven hermetic scroll-type compressor of the kind described above is shown in, for example, Japanese Patent Laid-Open No. 73886/1982.

In this type of compressor, the discharge valve is adapted to be closed when the compressor stops operating, in order to prevent reversing of the orbital scroll member due to a reversing flow of the compressed fluid. As this discharge valve is closed, the equilibrium state of pressure is established between the interior of the compressor and the low-pressure side of the system to which the compressor is connected, so that the lubricating oil, which has been forcibly fed by the differential pressure, is undesirably allowed to flow back to the suction side through the communication hole. Consequently, only a small amount of lubricating oil is left in the oil reservior within the closed vessel and, hence, it is often experienced that the bearings and other sliding parts are burned due to insufficient lubrication soon after a re-start of operation of the compressor. The relief of the lubricating oil to the low-pressure side would be avoided if the discharge valve is omitted because, by so doing, a high pressure is maintained in the compression chamber even after the stopping of the compressor. However, the elimination of the discharge valve causes another problem: namely, a reversing of the orbital scroll member accompanied by unfavorable reversing noise. The problem of noise caused by the reversing of the fluid is encountered also in screw-type refrigerant compressors. In order to avoid this problem, Japanese Patent Publication No. 3803/1983 proposes a screw-type compressor having check valves disposed in the suction and discharge pipes. In this screw-type compressor, the suction-side check valve disposed in the suction pipe is spaced considerably from the compression chamber of the compressor, so that the low pressure is left in an ample space even after the closing of the suction-side check valve. This proposal, therefore, cannot satisfactorily overcome the problem of relief of the lubricating oil to the suction side which may lead to a decrease in the amount of oil residing in the oil reservoir of the closed vessel and a consequent insufficient lubrication.

SUMMARY OF THE INVENTION

Accordingly, a primary object of the invention is to provide a scroll-type compressor improved to avoid the reversing of the orbital scroll member due to reversing flow of the fluid from the high-pressure side, as well as relief of the lubricating oil, even after a stop of operation of the compressor.

To this end, according to the invention, there is provided a scroll-type compressor comprising an orbital scroll member and a stationary scroll member each having a disc-shaped end plate and a spiral wrap protruding upright from the end plate, the scroll members being assembled together with their wraps meshing with each other to define compression chambers therebetween, means for causing an orbital movement of the orbital scroll member without permitting the orbital scroll member to rotate around its own axis, and a discharge port formed in a central portion and a suction port formed in a peripheral portion of the end plate of the stationary scroll member. As the orbital scroll member makes the orbital movement, the compression chambers are moved towards the center while decreasing their volumes to thereby progressively compress a gas sucked through the suction port and to discharge the compressed gas through the discharge port. A check valve is disposed in a gas passage which is formed through the thickness of the end plate of the stationary scroll member so as to communicate with a suction chamber formed between the scroll members.

According to a preferred form, the gas passage formed through the thickness of the end plate of the stationary scroll member is formed to extend in the axial direction of the scroll members at a position near the wrap end of the spiral wrap of the stationary scroll member.

The gas passage can open at its lateral side in a width smaller than the diameter thereof substantially over the whole height of the wrap.

The check valve may be composed of a spring disposed in the gas passage opened at its lateral side, a valve plate urged by the spring, and a seat surface adapted to be closely contacted by the valve plate, the seat surface being constituted by the end surface of a suction pipe inserted into the gas passage formed through the thickness of the end plate of the stationary scroll member.

The above and other objects, features and advantages of the invention will become clear from the following description of the preferred embodiment taken in conjunction with the accompanying drawings.

DESCRIPTION OF THE PREFERRED EMBODIMENT

Figure 1:
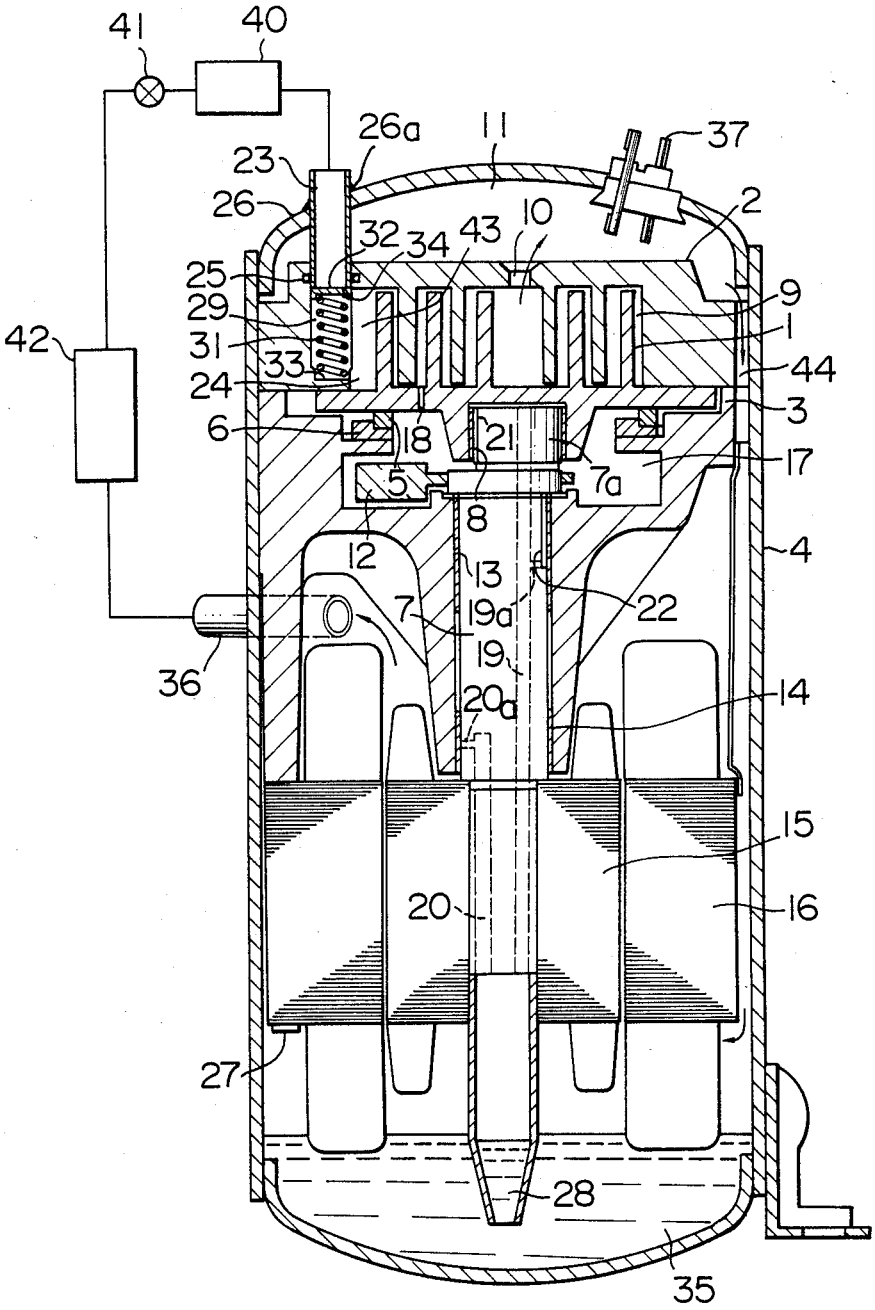
FIG. 1 is a sectional view of a scroll-type compressor in accordance with the invention.

Referring to the drawings, an orbital scroll member 1 and a stationary scroll member 2, each having an end plate and a spirally curved wrap protruding upright from the end plate, are assembled together with a frame 3 to form a compressor section which is fixed in an inner sleeve 4 constituting a hermetic closed vessel. An Oldham's key 5 and an Oldham's ring 6, in slidable engagement with each other, are disposed in a back-pressure chamber 17 formed behind the orbital scroll member 1 between the latter and the frame 3. A crankshaft 7 has an eccentric pin *7a* received by an orbital bearing 8 integral with the orbital scroll member 1. The wraps of the orbital scroll member 1 and the stationary scroll member 2 mesh with each other to form closed chambers 9 therebetween. The closed chambers 9 progressively decrease their volumes in accordance with the orbital movement of the orbital scroll member 1 and finally come into communication with the discharge port 10 which is formed in the central portion of the stationary scroll member 2. The discharge port 10 opens to a space 11 formed by a chamber 26 constituting the closed vessel. A balancing weight 12 is fixed to the crankshaft 7 and the crankshaft 7 is supported by an upper main bearing 13 and a lower main bearing 14. The electric motor section of the compressor has a rotor 15 connected to the end of the crankshaft 7 opposite to the eccentric pin *7a*, and a stator 16 fixed to the frame 3 of the compressor by means of bolts 27. A communication hole 18 is formed through the thickness of the end plate of the orbital scroll member 1 so as to provide a communication between the closed vessel 9 and the back-pressure chamber 17. An oil passage bore 19 extends through the crankshaft 7 along the length thereof to open in a lubricating oil drawing section 28 provided at the lower end of the crankshaft 7. The other end of the oil passage bore 19 opens in the end surface of the eccentric pin *7a* of the crankshaft 7. A radial lubricating passage bore **19*a* branches from the oil passage bore 19 to provide communication between the latter and an oil groove 22. Another oil passage bore 20 has a lower end opened in the lubricating oil drawing section 28 and the other end opened to the lower main bearing 14 mentioned before through a radial lubricating passage bore 20*a*. The oil groove 21 is formed along the axial length of the orbital bearing 8. A suction pipe 23 has one end extended through the wall of the chamber 26 for connection to a low-pressure equipment such as an evaporator and an end inserted into a hole formed through the thickness of the end plate of the stationary scroll member 2. The suction pipe 23 is welded to the wall of the chamber 26 as at 26*a*, while an "O" ring 25 is fitted around the other end of the suction pipe 23 received by the hole in the end plate of the stationary scroll member 2 to provide a seal between the wall of the suction pipe 23 and the hole. The "O" ring effectively absorbs any deformation of the suction pipe 23 which may be caused forcibly by the high internal pressure of the suction pipe 23, so that no substantial stress is applied to the suction pipe 23** even when the latter is subjected to a high internal pressure.

Figure 2:
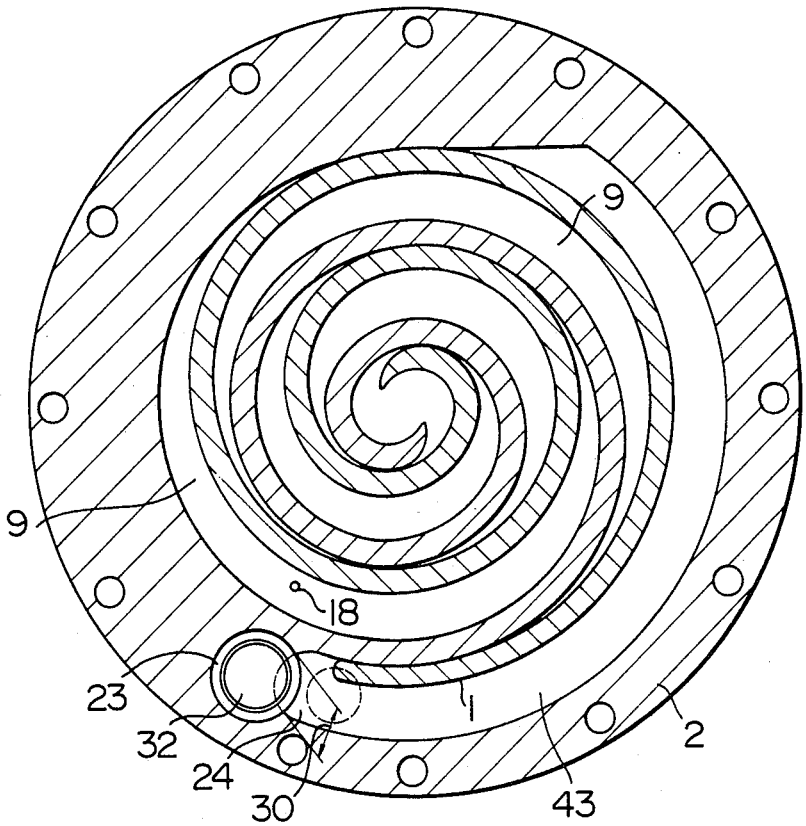
FIG. 2 is a sectional plan view of a portion of the scroll-type compressor showing how the wraps of both scroll members mesh with each other.

A passage 29, having a circular cross-section, is formed to extend axially through the thickness of the end plate of the stationary scroll member 1. The passage 29 is opened at its lateral side portion in a width smaller than the diameter thereof substantially over the entire height of the wraps so as to form an elongated opening 30. As will be clearly seen from FIG. 2, the elongated opening 30 faces the arcuate end of the wrap end portion 24 of the wrap on the stationary scroll member so as to communicate with a suction chamber 43 formed between the wraps of both scroll members 1 and 2. A spring 31, received by the passage 29, is seated on the bottom 33 of the passage 29 so as to push a valve plate 32 upward. The valve plate 32 has a seat surface which is held in close contact with the lower end surface 34 of the suction pipe 23 when the compressor is not operating. The wrap end portion 24 of the stationary scroll member 2 is shaped in an arcuate form to facilitate the formation of the elongated opening 30 of the passage 29. Lubricating oil 35 is collected in the oil reservoir constituted by the bottom of the closed vessel. A discharge pipe 36 and an electric power supply terminal. 37 are also provided along with an evaporator 40, an expansion valve 41 and a condenser 42 forming a portion of a refrigeration cycle.

The operation of the scroll-type compressor in accordance with the invention is as follows.

In the non-operative state of the scroll-type compressor shown in FIG. 1, the valve plate 32 is pushed upward into contact with the lower end surface 34 of the suction pipe so as to close the passage 29, and the pressure in the suction chamber 43 is equal to or slightly higher than the pressure in the low-pressure side including the evaporator 40. As the electric motor is started, the crankshaft 7 is driven to cause an orbital movement of the orbital scroll member 1 so that the gas in the suction chamber 43 is confined in the compression chamber 9 and is progressively compressed so as to be discharged into the space 11 through the discharge port 10. As the gas in the suction chamber 43 is consecutively taken away into the successive compression chambers, the pressure in the suction chamber 43 is reduced to create a pressure difference across the valve plate 32 of the check valve so that the valve plate 32 is lowered overcoming the force of the spring 31 by the force developed by this pressure differential. In the operation of the compressor, the valve plate 32 is always maintained away from the cooperating end surface of the suction pipe to keep the passage 29 opened sufficiently so that the gas is continuously drawn. The compressed gas of high pressure and temperature discharged into the space 11 contains the lubricating oil 35. This gas together with the lubricating oil 35 is introduced into the electric motor section through a passage 44. The electric motor, which has been heated, due to operational heat, to a temperature higher than the gas temperature, is effectively cooled through the contact with the compressed gas. When the gas containing the lubricating oil 35 collides with the stationary part such as the motor housing, the lubricating oil 35 is separated from the gas and is collected in the oil reservoir formed by the bottom of the closed vessel, while the gas having small oil content flows into the condenser 42 through the discharge pipe 36. The gas in the condenser 42 makes a heat exchange with the ambient air to radiate the heat so as to be liquefied. The liquefied fluid is then allowed to expand through the expansion valve 41 into the evaporator 40 where it is evaporated by the heat derived from the ambient air thereby to cool the air. The evaporated fluid, i.e. the gas, is then drawn through the scroll-type compressor so as to be compressed again by the latter.

The lubricating oil 35 is circulated by the pressure differential between the high-pressure established in the closed vessel and the intermediate pressure established in the back-pressure chamber 17. More specifically, the lubricating oil 35 is sucked through the lubricating oil drawing section 28 and is delivered to the upper and lower main bearings 18 and 14, as well as to the orbital bearing 8, through the oil passage bores 19,20 and radial passage bores 19*a*,20*a*. Every part of the lubricating oil 35 after the lubrication temporarily stored in the back-pressure chamber 17 and is discharged through the communication hole 18 into a compression chamber 9 in which the pressure is still lower than that in the back-pressure chamber 17. The lubricating oil is then mixed with the gas in the compression chamber 9 so as to be compressed together with the gas.

As the compressor stops to operate, the discharged compressed gas tends to flow backwardly to the low-pressure side. However, simultaneously with the stopping of the operation of the compressor, a pressure equilibrium is attained between the space in the suction pipe 23 and the space in the suction chamber 43, so that the spring 31 is released to push the valve plate 32 thereby to close the passage 29. Since the above-mentioned pressure equilibrium is attained simultaneously with the stop of operation of the compressor, the check valve operates to close the passage 29 in quite a short period of time after the operation of the compressor stops.

Consequently, no substantial reverse flow of the fluid to the low-pressure side takes place and, therefore, the undesirable reversing of the orbital scroll member 1 is avoided. In addition, the lubricating oil 35 relieved through the communication hole 18 into the compression chamber 9 is allowed to flow back only into the suction chamber 43 which has a small volume, so that the shortage of the lubricating oil 35 in the compressor after the stopping of operation of the compressor is avoided and a sufficient lubrication of the compressor is ensured when the operation is re-started.

As will be understood from the foregoing description, the scroll-type compressor of the invention is freed from the problem of noise produced by the reversing of the orbital scroll member due to the prevention of the undesirable reversing flow of the working fluid which takes place inevitably in the conventional scroll-type compressor after a stop of operation. In addition, the relief of the lubricating oil to the low-pressure side is also prevented to avoid troubles such as burning of the bearings which tends to occur in the conventional scroll-type compressor due to insufficiency of lubrication after a restart of the operation.

Although the invention has been described through specific terms, it is to be noted here that the described embodiment is only illustrative and various changes and modifications may be imparted thereto without departing from the scope of the invention which is limited solely by the appended claims.

What is claimed is:

1. A scroll-type compressor comprising an orbital scroll member and a stationary scroll member each having a disc-shaped end plate and a spiral wrap protruding upright from said end plate, said scroll members being assembled together with the wraps meshing with each other to define compression chambers therebetween, means for causing an orbital movement of said orbital scroll member without permitting said orbital scroll member to rotate around its own axis, a discharge port formed in a central portion and a suction port formed in a peripheral portion of said end plate of said stationary scroll member, whereby, as said orbital scroll member makes orbital movement, said compression chambers are moved towards the center while decreasing their volumes to thereby progressively compress a gas drawn through said suction port and to discharge the compressed gas through said discharge port, a gas passage means formed in a thickness of the end plate of said stationary scroll member for communication with a gas suction chamber formed between the scroll members, said gas passage means extending in an axial direction of said scroll members at a position where said gas passage means partially overlaps with a portion of said gas suction chamber near a wrap end portion of said spiral wrap of said stationary scroll member so that said gas passage means has an opening formed at a lateral side thereof for communication with said gas suction chamber, said opening having a width smaller than a width of said gas passage means and extending substantially over an entire height of said wraps, and a check valve means disposed in the gas passage means and including a valve plate resiliently urged for controlling a communication of said gas passage means with said gas suction chamber, said passage means being adapted to serve as a guide for allowing said valve plate to slide therein in an axial direction of said scroll members.

2. A scroll-type compressor as set forth in claim 1, wherein a spring means is disposed in said gas passage means for resiliently urging the same to control the communication between said gas passage means and said gas chamber means, a seat surface is adapted to be closely contacted by said valve plate, said seat surface including an end surface of a suction pipe inserted into said gas passage means.

* * * * *